United States Patent [19]

Wöber

[11] Patent Number: 4,893,838

[45] Date of Patent: Jan. 16, 1990

[54] HOLDING DEVICE FOR PRINTED MATTER

[76] Inventor: Irmfried Wöber, No. 1018, A-3042, Würmla, Austria

[21] Appl. No.: 209,501

[22] Filed: Jun. 21, 1988

[30] Foreign Application Priority Data

Jul. 9, 1987 [AT] Austria ..... 1733/87

[51] Int. Cl.[4] ..... B42D 3/08; B42D 17/00; B42F 15/00; B65D 27/00

[52] U.S. Cl. ..... 281/45; 281/29; 40/359; 40/360

[58] Field of Search ..... 281/29, 45, 46, 47, 281/50; 225/27; 40/124.1, 359, 360

[56] References Cited

U.S. PATENT DOCUMENTS

| | | | |
|---|---|---|---|
| 1,249,411 | 12/1917 | Joseph | 40/359 |
| 1,528,087 | 3/1925 | Sheridan et al. | 281/29 |
| 1,555,566 | 9/1925 | Furste . | |
| 3,726,412 | 4/1973 | Resnicoff | 211/135 |
| 4,190,151 | 2/1980 | Russell | 40/360 |
| 4,424,106 | 1/1984 | Rossoshiwsky et al. | 204/256 |
| 4,424,906 | 1/1984 | Richmond | 211/50 |

FOREIGN PATENT DOCUMENTS

| | | | |
|---|---|---|---|
| 3514484 | 10/1986 | Fed. Rep. of Germany | 281/45 |
| 1157993 | 6/1958 | France | 40/359 |
| 1462451 | 12/1966 | France | 40/359 |
| 2440571 | 7/1980 | France | 40/359 |

OTHER PUBLICATIONS

Great Britain Specification No. 945,937.

*Primary Examiner*—Douglas D. Watts
*Assistant Examiner*—Paul M. Heyrana, Sr.
*Attorney, Agent, or Firm*—Paul & Paul

[57] ABSTRACT

The invention relates to a holding device produced by folding a blank of sheet material which is improved so as to safely hold printed matter of various widths down to the last sheet. This is achieved according to the invention in that the sheet material is subdivided into a front wall panel and a back wall panel connected to one another by a portion forming the lower boundary of the printed matter and two webs with fold lines forming lateral boundaries. The front wall panel and the back wall panels being separated by two circular cuts each emanating at the lower end of the webs and the upper ends of the circular cuts each terminating in a straight cut and that a horizontal fold line connecting the front wall panel to the back wall panel via said portion is provided between the lower ends of said circular cuts and the upper part of said circular cuts.

4 Claims, 2 Drawing Sheets

HOLDING DEVICE FOR PRINTED MATTER

Figure 1:
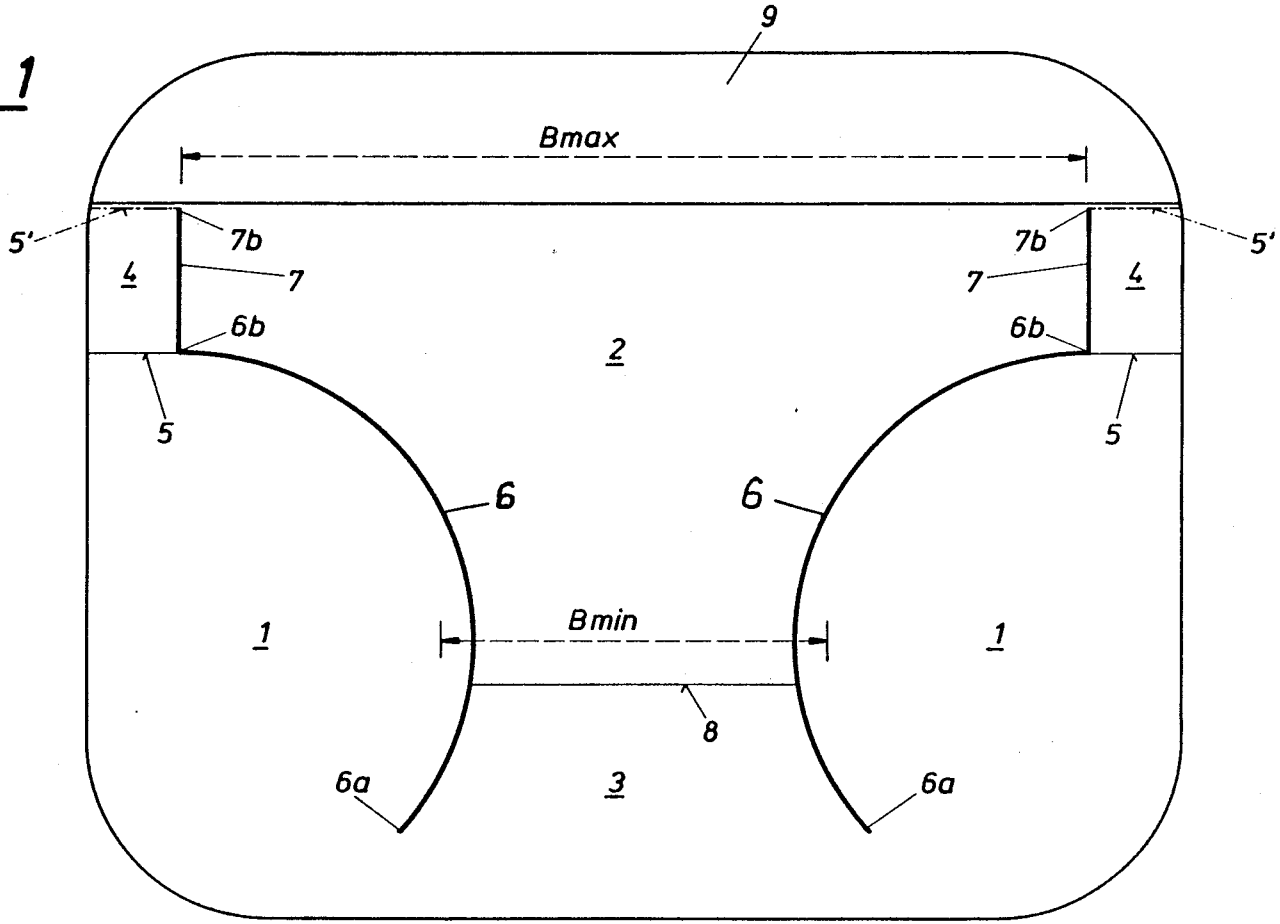

The present invention relates to a holding device for printed matter, stationery or the like, in particular cards, brochures and prospectuses, which is formed open in its upper side to give access to its content and is produced by folding a blank of sheet material provided with appropriate cuts and fold lines.

It is the object of the invention to improve such a holding device so that it can hold printed matter of various widths safely down to the last sheet, at the same time keeping the production cost as low as possible. This is achieved in the holding device initially mentioned according to the invention by sub-dividing the preferably transparent sheet material, for instance hard PVC, into two panels forming the front and back walls of the holding device when the blank is folded, the panels being connected to one another by a portion forming the lower boundary of the printed matter on folding and two webs having a horizontally extending fold line in position of use of the holding device forming the lateral boundary of the printed matter, by separating the panels forming the front and back walls of the holding device by two cuts emanating from the lower end of the web in using position of the holding device and extending along a circular line, each of the cuts being longer than a quarter circle and shorter than a half circle and the upper ends of these circular cuts each terminating in a vertically extending straight cut separating the webs from the panel forming the back wall and a horizontal fold line connecting the panels forming the front and back walls via the portion extending between the lower ends of the circular cuts and the upper part of the circular cuts corresponding to a quarter circle.

By this special embodiment of a holding device for printed matter according to the invention, an overlapping zone between the front and back walls of the holding device holding the printed matter is provided, so that printed matter of various widths is safely held. Moreover, the particular arrangement of the fold lines on folding the holding device creates (residual) internal stress in the individual panels or portions and thus an opposingly directed curvature of the front and back walls of the holding device by which the printed matter is held by means of friction down to the last sheet. This prevents unintentional loss of printed matter by wind or draft created by people hurrying past the holding device and thus safely prevents the frequently encountered and unattractive spectacle of printed matter scattered all over the floor underneath the holding device.

Moreover, the holding device according to the invention is very simple and inexpensive to produce and very easy to manipulate.

U.S.-PS 44 42 906 describes a holder for small packages folded of a flat blank, although the cavity for receiving the packages is of conventional parallelepiped form.

U.S.-PS 37 26 412 describes an advertising carrier which is folded from a flat blank into a honeycomb shape by means of slits and is inscribed with the advertising text itself instead of holding printed matter.

U.S.-PS 15 55 566 also discloses an advertising carrier folded of a flat blank having a semicylindrical advertising surface carrying an advertising text; no holding of printed matter is provided in this case, either.

In a further development of the invention, the horizontal fold line provided on each web can be arranged on the lower end of the web adjacent the upper end of the circular cut. The horizontal fold line provided on each web could also be arranged on the upper end of the web and the upper end of the straight cut.

It is further convenient to provide the upper marginal area of the panel forming the back wall at least partially with an adhesive layer. This allows for the fast and simple attachment of the holding device according to the invention on smooth vertical surfaces, for instance on sales shelves, announcement boards and the like.

Figure 3:
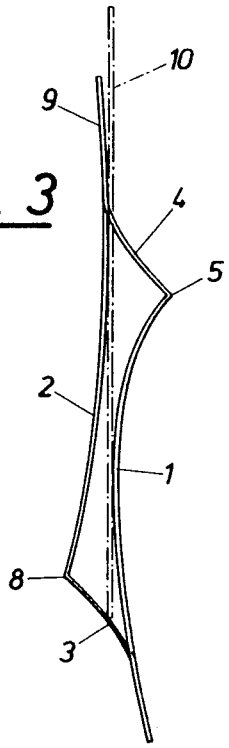
Figure 2:
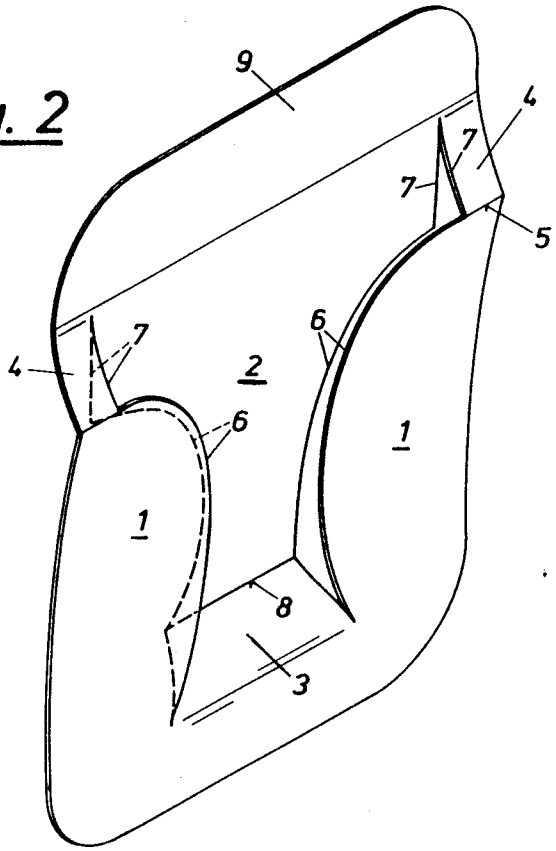

The invention is explained in detail in the following by means of an exemplary embodiment of the object of the invention under reference to the accompanying drawings, wherein FIG. 1 shows a top plan view of the flat sheet material forming the holding device according to the invention provided with cuts and fold lines;

FIG. 2 shows the holding device formed by folding the material according to FIG. 1 in diagonal view and FIG. 3 shows a side view of the holding device formed by folding the sheet material according to FIG. 1 with sketched printed matter.

The transparent sheet material shown in FIG. 1 consisting of hard polyvinyl chloride with rounded outer corners is subdivided into two panels 1,2 forming the front and back walls of the holding device on folding and connected to one another by a portion 3 forming the lower boundary for the printed matter 10 (see FIG. 3) on folding and two webs 4 forming the lateral boundary for the printed matter 10. Two cuts 6 which begin at **6*b* and extend in a semicircle, toward the lower boundary 3. The cuts 6 terminate at 6*a*. The semicircle formed by each cut 6 is longer than a quarter circle and shorter than a half circle and provides for the separation of the panels 1 and 2 forming the front and back walls. The radii of these circular cuts 6 depend on the formats of the printed matter to be held. Each of the upper ends 6*b* of these circular cuts 6 terminates in a (viewed in position of use of the holding device) vertically extending straight cut 7 separating the webs 4 from the panel 2 forming the back wall. The cuts 6,7** are drawn thicker than the other lines.

Each web 4 has a fold line 5 or 5', which is horizontal in relation to the position of use of the holding device. 5 illustrates the preferred position of said fold line is on the lower end of the web 4 tangentially adjacent the upper end **6*b* of the circular cut 6 and is shown at 5. However, and as alternatively shown by the dash-dotted line 5' in FIG. 1, this fold line could also be arranged on the upper end of the web 4, thus on the upper end 7*b* of the straight cut 7**.

A further horizontal fold line 8 is provided in the area between the lower ends **6*a* of the circular cuts 6 and the upper parts of the circular cuts 6 each corresponding to a quarter circle, said fold line 8 connecting the panels 1,2 forming the back and front walls to one another via the portion 3**.

The upper marginal area of the panel 2 forming the back wall can be provided on its front and/or back side at least partially with an adhesive layer 9 in order to permit the easy glueing of the holding device according to the invention to a supporting element such as a shelf, a shop window, an announcement board or the like.

By the dimensional arrows Bmin, Bmax shown in broken lines in FIG. 1, the large variability of the widths of the printed matter 10 received and safely held in a holding device according to the invention formed in a certain size is evident.

FIGS. 2 and 3, which are of reduced scale as compared to FIG. 1, show how the panels 1 and 2, which are first lying in a plane (FIG. 1), are folded around the fold lines 5 or 5' and 8 so that the surface areas adjacent the fold lines 5 or 5' and 8 form an angle of e.g. 110° to 150°. Due to the internal elastic stress of the sheet material, the panels 1 and 2 curve towards one another so that the supply of printed matter (of which one specimen of printed matter 10 is shown in dash-dotted lines in FIG. 3) between the inner or rear surface of the panel 1 forming the front wall and the inner or front surface of the panel 2 forming the back wall is held in its central area by these curvatures of the panels 1,2 under elastic stress and slight friction. Any unintended loss of specimens of the printed matter supply by draft or the like is excluded with certainty, instead, each individual specimen must be intentionally withdrawn from the holding device.

Suitable sheet material for the holding device according to the invention, in addition to the hard polyvinyl sheet already mentioned, are other plastic materials such as polystyrene sheet or polypropylene sheet resistant to impact.

I claim:

1. A holding device for printed and paper goods, comprising a blank sheet of transparent material having two sides, a top and a bottom and a front and back wall, which sheet is subdivided into a first and second panel by two semicircular cuts, each cut beginning at a distance from the bottom of said sheet and continuing toward the top of said sheet in a semicircle, said semicircle forming at least a quarter circle, but less than a half circle, with each of the upper ends of said semicircular cuts terminating in a straight cut further extending toward the top of said sheet and terminating at a distance short of the top of said sheet, so that said first panel comprises a first web along the bottom of said sheet with sides delinated by said semicircular and straight cuts and a second web along the top of said sheet, with a first and second fold line extending between said straight cut and the side of said sheet, and so that said second panel comprises that portion of sheet material delineated by the semicircular and straight cuts with a third fold line extending between said semicircular cuts, which is placed between the lower ends of said semicircular cuts and that part of said semicircular cuts corresponding to at least a quarter circle.

2. The holding device according to claim 1, wherein the first and second fold lines are arranged on the lower end of the web adjacent the upper end of the semicircular cut.

3. The holding device according to claim 1, wherein the first and second fold lines are arranged on the upper end of the web and on the upper end of the straight cut.

4. The holding device according to any one of the claims 2, 3 or 1, wherein the upper marginal areas of the panel forming the back wall is at least partially provided with an adhesive layer.

* * * * *